United States Patent [19]

Palange

[11] 4,362,032

[45] * Dec. 7, 1982

[54] APPARATUS FOR USE IN PRODUCING KNIT FABRICS

[76] Inventor: Walter Palange, 989 Aqua Cir., Naples, Fla. 33940

[ * ] Notice: The portion of the term of this patent subsequent to Jan. 27, 1998, has been disclaimed.

[21] Appl. No.: 93,882

[22] Filed: Nov. 13, 1979

Related U.S. Application Data

[60] Continuation-in-part of Ser. No. 23,455, Mar. 23, 1979, Pat. No. 4,246,768, which is a division of Ser. No. 886,776, Mar. 15, 1978, Pat. No. 4,193,273.

[51] Int. Cl.[3] ..... D04B 3/00

[52] U.S. Cl. ..... 66/4; 66/117

[58] Field of Search ..... 66/1 A, 1 R, 4, 117, 66/118, 214

[56] References Cited

U.S. PATENT DOCUMENTS

| | | | |
|---|---|---|---|
| 2,138,108 | 11/1938 | Lapham | 66/1 A UX |
| 2,318,018 | 5/1943 | Semonsen | 66/4 |
| 2,457,064 | 12/1948 | Parisi | 66/4 |
| 2,539,479 | 1/1951 | Robertson | 66/1 A |
| 3,143,868 | 8/1964 | Palange | 66/1 R |
| 4,246,768 | 1/1981 | Palange | 66/4 |

FOREIGN PATENT DOCUMENTS

| | | | |
|---|---|---|---|
| 174692 | 4/1953 | Austria | 66/4 |
| 136019 | 12/1902 | Fed. Rep. of Germany | 66/4 |
| 204750 | 12/1908 | Fed. Rep. of Germany | 66/214 |
| 521894 | 3/1931 | Fed. Rep. of Germany | 66/4 |
| 1076305 | 2/1960 | Fed. Rep. of Germany | 66/214 |
| 2128075 | 12/1972 | Fed. Rep. of Germany | 66/1 R |
| 1397982 | 3/1965 | France | 66/214 |
| 310922 | 9/1933 | Italy | 66/4 |
| 50-19655 | 9/1975 | Japan | 66/214 |
| 257093 | 3/1949 | Switzerland | 66/4 |
| 24660 | of 1894 | United Kingdom | 66/4 |

*Primary Examiner*—W. Carter Reynolds
*Attorney, Agent, or Firm*—Holman & Stern

[57] ABSTRACT

Apparatus for manually producing a knit fabric comprises a series of knitting supports positioned along the edge of a base member on which supports the fabric is produced and supported, and at least one curved needle having a pair of yarn-threading eyes, which needle carries yarn from a yarn supply and is manipulated in conjunction with the supports to produce stitches thereon.

9 Claims, 21 Drawing Figures

FIG. 15
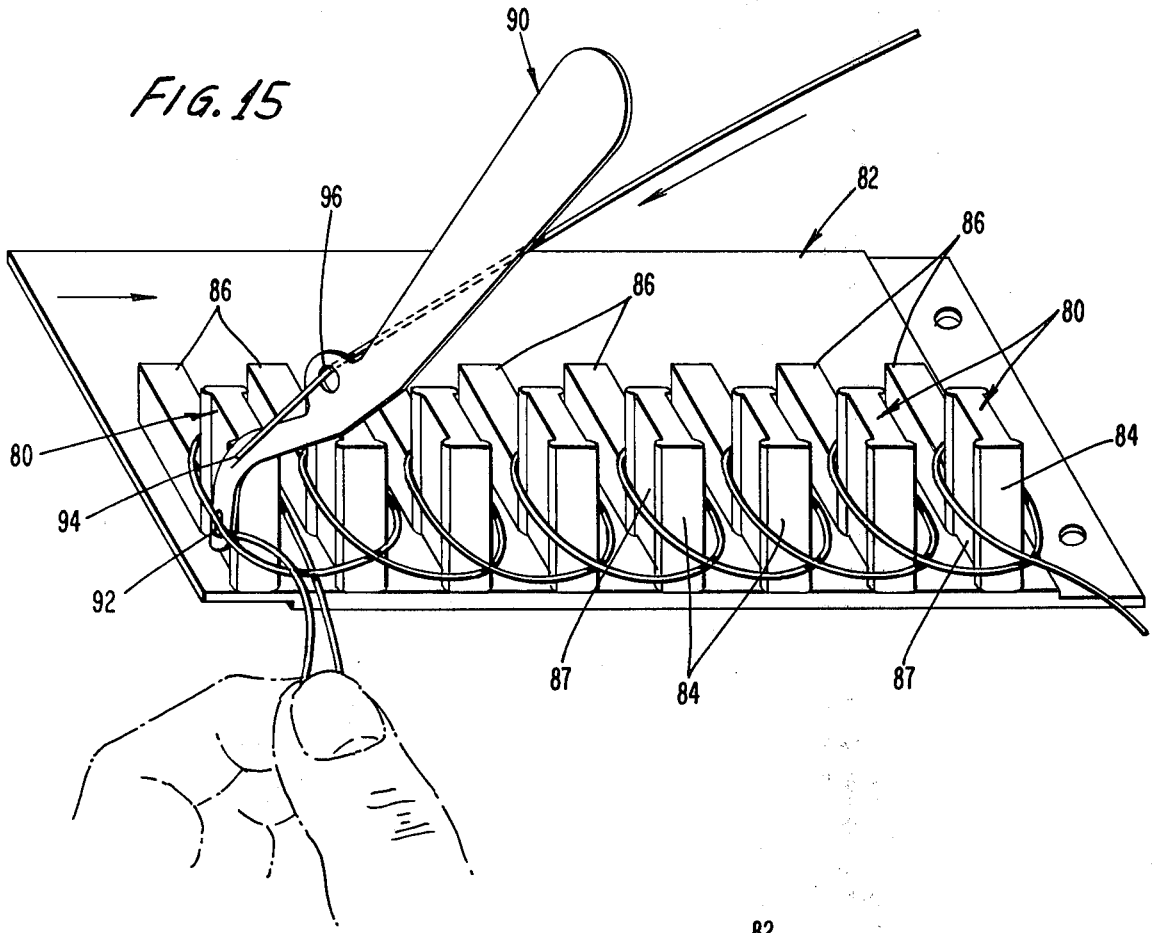
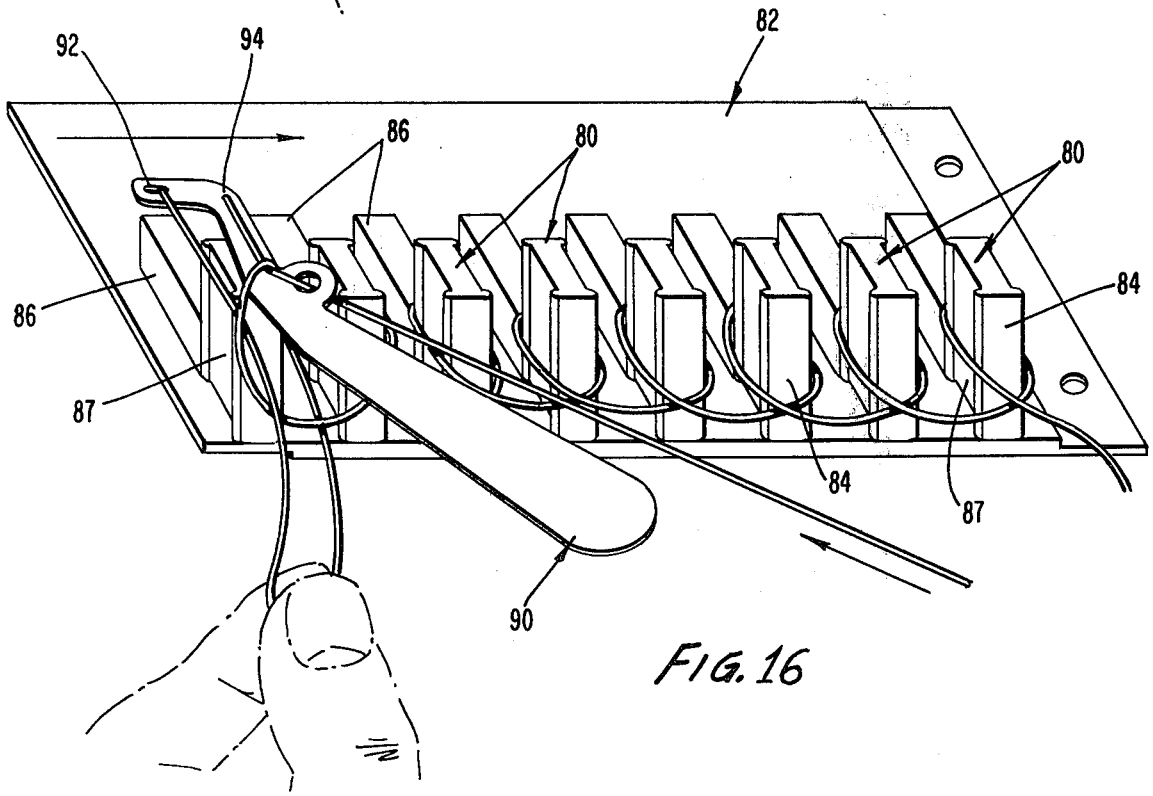
FIG. 16

FIG. 17
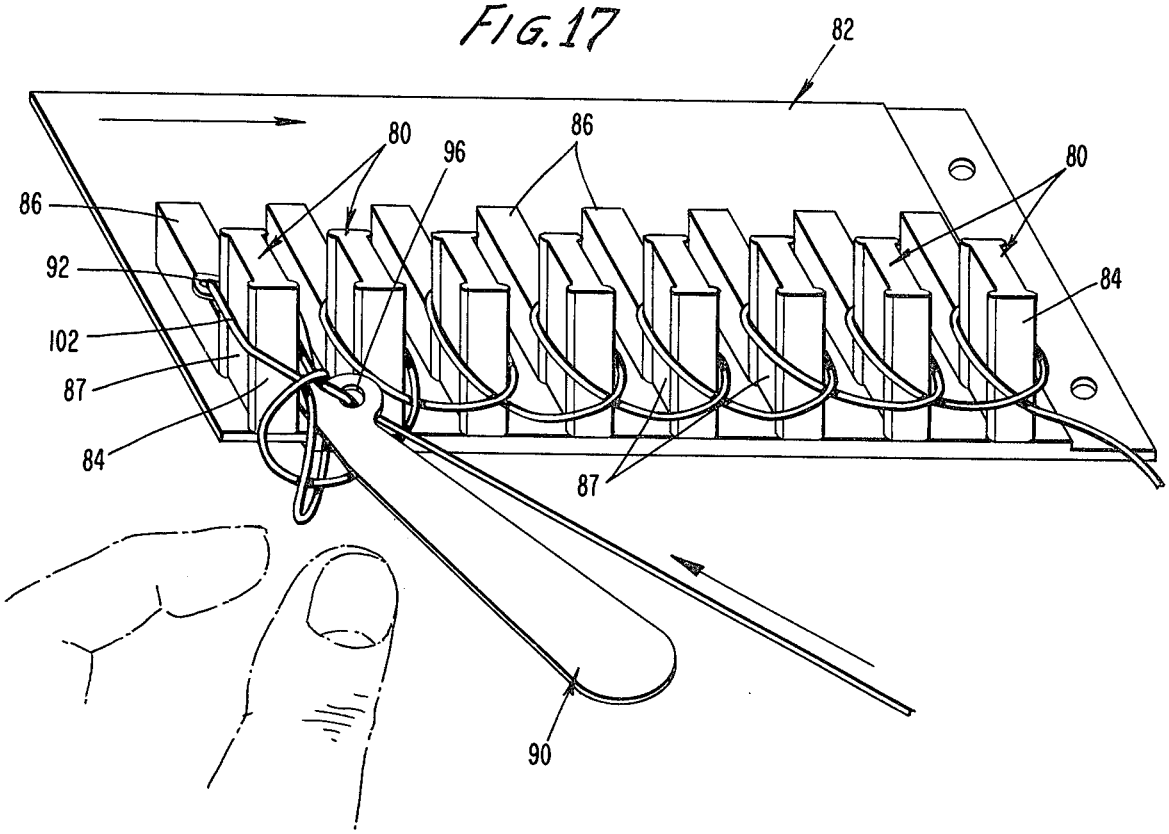
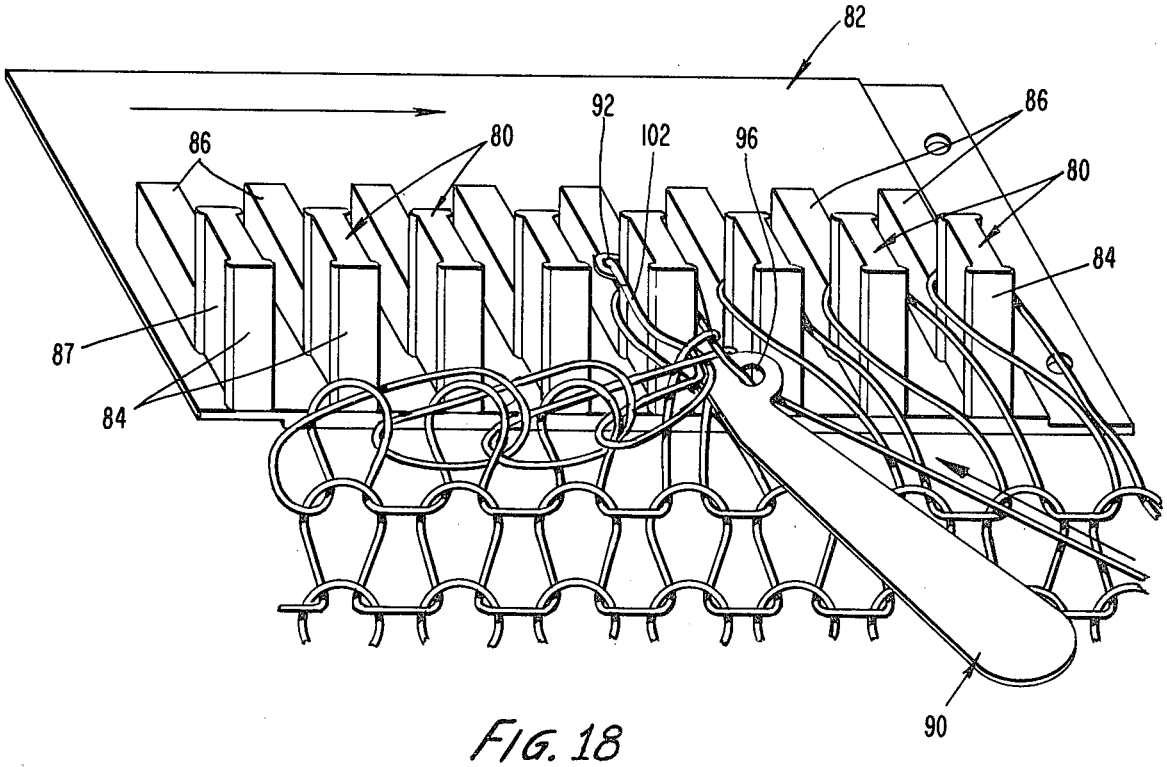
FIG. 18

APPARATUS FOR USE IN PRODUCING KNIT FABRICS

BACKGROUND OF THE INVENTION

This application is a continuation-in-part of application Ser. No. 23,455 filed Mar. 23, 1979, now U.S. Pat. No. 4,246,768 which in turn is a divisional application from application Ser. No. 886,776 filed Mar. 15, 1978, now U.S. Pat. No. 4,193,273.

The invention relates to apparatus with which manual knitting operations can be performed to produce diverse types of knit fabrics.

It is an object of the invention to provide apparatus of a simple and economical construction which can be used with a minimum of instruction to perform diverse types of knitting operations and produce various different types of knitted fabrics.

It is another object of the invention to provide a knitting apparatus on which different forms of stitches and different knitting patterns can be produced by suitable manual manipulation of hooked needles used in conjunction with stationary knitting supports.

It is still another object of the invention, in one of its aspects, to provide a simple apparatus on which knit fabrics can be readily produced by manual operation, utilizing a plurality of yarns of different color and/or character while minimizing the possibility of such yarns becoming entangled during the knitting process.

It is a further object of this invention, in another of its aspects, to provide an apparatus on which knit fabrics can be produced having different spacing between selected stitches.

It is a still further object of the invention to provide apparatus on which a knitted fabric can be produced and into which velour or like staples can be incorporated to provide a pile fabric.

BRIEF SUMMARY OF THE INVENTION

In accordance with the invention, apparatus for use in producing knit fabrics comprises a plurality of spaced upright supports carried by a base member, on which support stitches are produce and on which the knitted fabric is supported and at least one hooked knitting needle having a pair of threading eyes for carrying a knitting thread or yarn and which is used to manipulate the yarn in conjunction with the stationary supports to produce the stitches.

In a preferred embodiment of the invention particularly useful for producing numerous different forms of knit fabrics including knit pile fabrics or knit fabrics with variable stitch spacing, the apparatus comprises a series of relatively squat upright supports arranged in line along the edge of a linear base member or around the circumference of a circular, oval, or other shaped base member. This arrangement is intended for use with one or more hooked yarn-carrying needles manipulated in conjunction with selected supports in turn to form and support rows of stitches thereby producing a knit fabric into which velour or like staples can be incorporated if required to form a pile fabric.

BRIEF DESCRIPTION OF DRAWINGS

In the accompanying drawings, which illustrate the invention by way of example:

FIGS. 14–18 are perspective views of yet another form of knitting apparatus showing progressive stages of stitch production respectively;

DETAILED DESCRIPTION OF PREFERRED EMBODIMENTS

Figure 1:
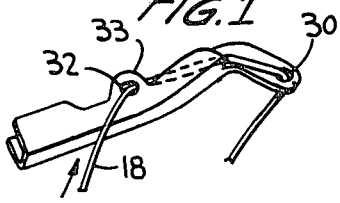
FIG. 1 is a side view of the forward end of one of the yarn-carrying needles of the present invention.

The hooked needles of the present invention, as shown in FIG. 1, have substantially planar, curved forward ends and have a pair of eyes 30 and 32, eye 30 being located at a forward tip of the needle and eye 32 being located at the rear of the curved forward end on a projecting portion 33 of the needle. As clearly shown, the eyes each have an axis perpendicular to the plane of the curved forward end of the needle. Further, the needles are channel-shaped in cross section up to an intermediate point approximately at the crest of the curved portion and the remainder of the curved portion up to the tip is an extension of one wall only of the channel. The needles are threaded with the yarn 18 from a yarn supply first through eye 32, the yarn then extending along the needle channel and passing through eye 30 onto the knitting apparatus.

Figure 2:
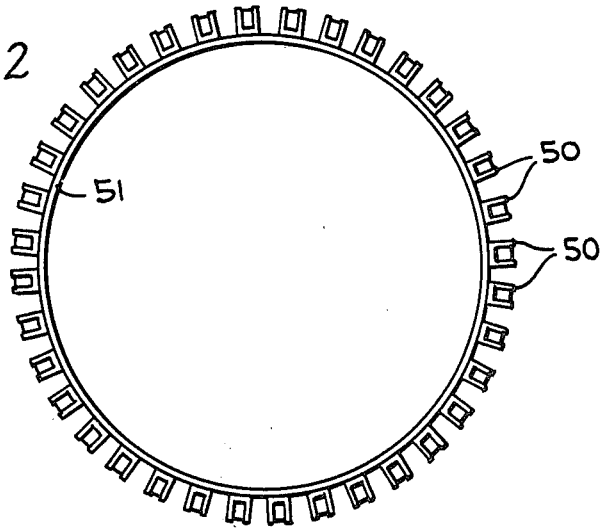
FIGS. 2 and 3 are respectively a plan view and an elevation of a support structure of a form of knitting apparatus of the present invention.
Figure 3:
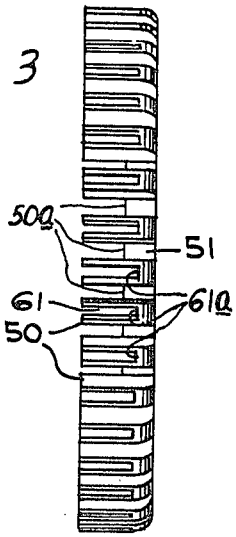
Figure 9:
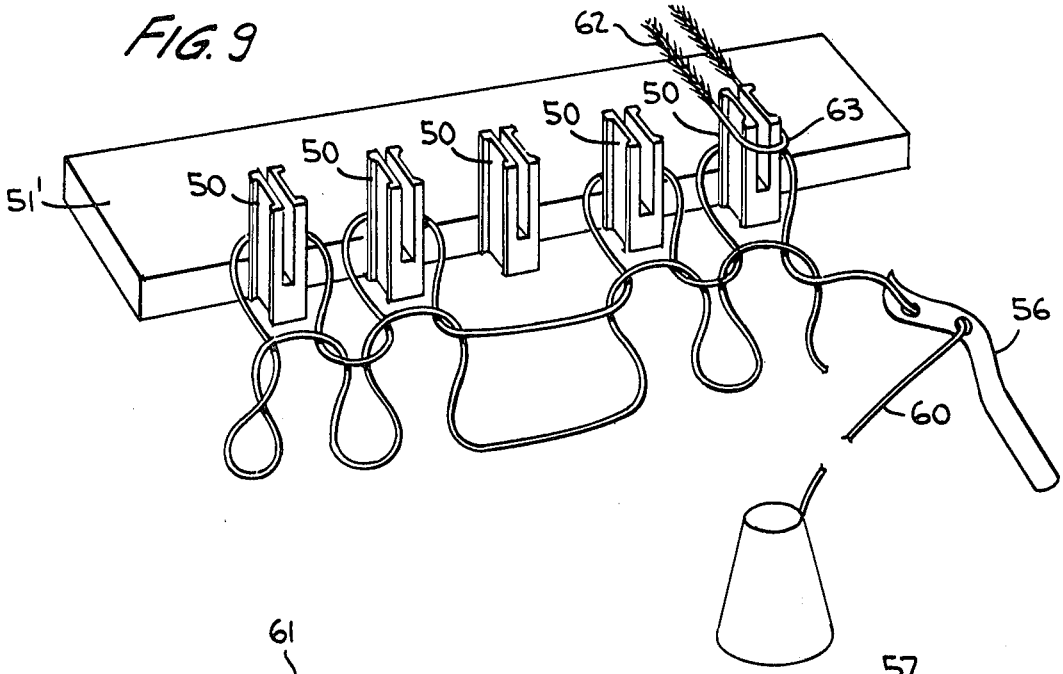
FIG. 9 is a perspective view of a further form of knitting apparatus of the type shown in FIGS. 2 and 3.

FIGS. 2–13 illustrate a form of apparatus in accordance with the invention which employs a series of knitting supports 50 arranged in spaced relation on a base member 51 of annular form around the periphery of the circle, as shown in FIGS. 2 and 3, to produce tubular knit fabrics, or in a line on base member 51', as shown in FIG. 9, to produce knit fabric in sheet form. This type of apparatus is primarily intended for use with a hooked needle 56 and can be operated to produce fabrics having a variable stitch spacing by omitting one or more supports as shown in FIG. 9 or to produce pile fabrics by the incorporation of staples, as shown in FIGS. 10–13.

Figure 5:
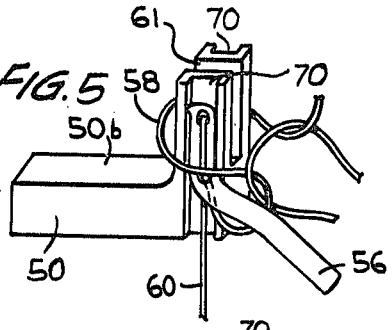
Figure 6:
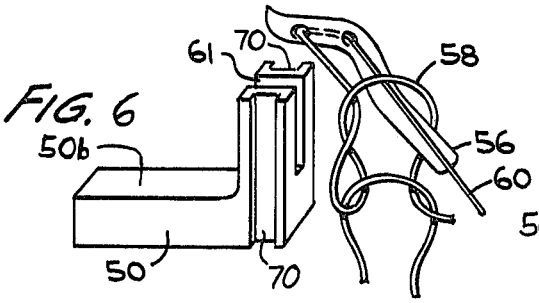
Figure 7:
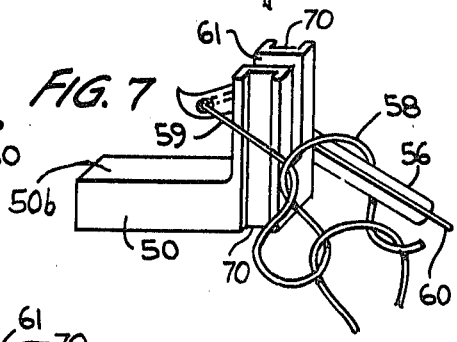
Figure 8:
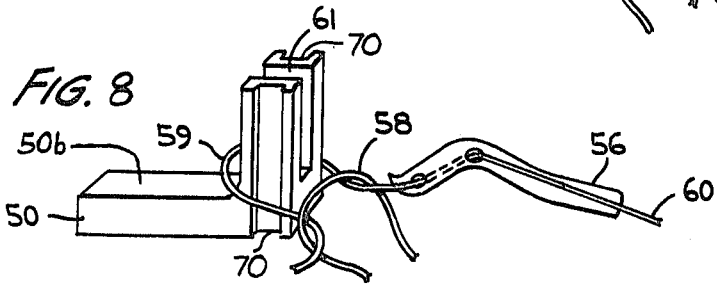

The supports 50 each have a forward upright portion with a longitudinal slot 61 in its free upper surface or end and the outer surfaces are longitudinally grooved at 70, as shown to facilitate needle insertion, as shown for example in FIG. 5, which also shows the support as including a rearwardly extending linear flange portion **50*b* with an upper surface above the level of the base of grooves 70. As shown in FIG. 3, the base member 51 has surface portions 50*a* between each pair of adjacent supports which surface portions are at a higher level than the bottom walls 61*a* of the slots in the supports so that in use, when a stitch is looped around a support and rests on surface portions 50*a*, a needle can be inserted into slot 61** below the level of the stitch, to facilitate lifting of the stitch off from the support.

Needle 56 is similar in form to the needle described with reference to FIG. 1 and has a substantially planar and arched forward end terminating in a tip with a pair of spaced eyes with axes perpendicular to the plane of the forward end and with yarn from a ball being threaded in use through the rear eye and then through the forward eye as shown. In this embodiment, the forward eye of the needle is adjacent the tip and the rearward eye of the needle is shown as being located substantially on the crest of the arched forward end of the needle.

In use, stitches are formed successively on individual supports by suitable manipulation of yarn-carrying needle 56, with the needles 56 carrying thread 60 from a supply having the function of taking loops off the supports 50 and discharging them into the fabric, at the same time preparing on the supports a new row of stitches for the next course. To take loops from the supports one or other of two different operating modes may be used.

Figure 4:
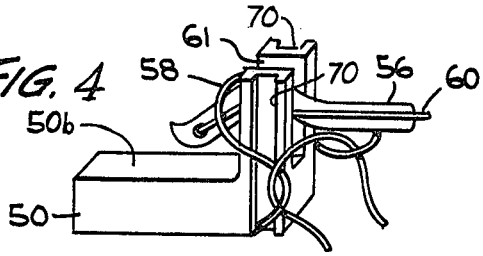
FIGS. 4–8 are perspective views of a support shown in progressive stages of stitch production.
Figure 10:
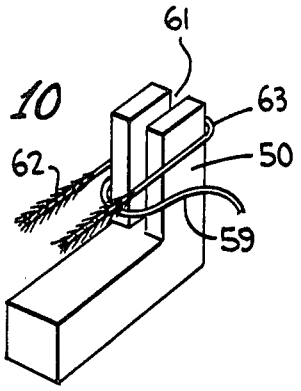
FIGS. 10–13 are perspective views of one of the supports showing progressive stages in the incorporation of a velour or like staple into a stitch to produce a pile fabric.
Figure 11:
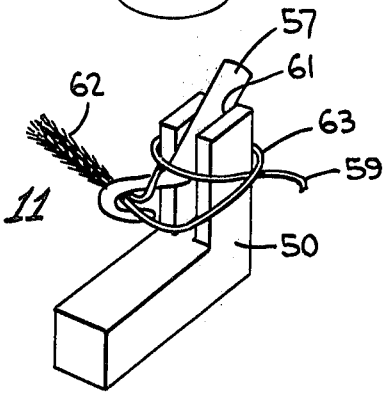
Figure 12:
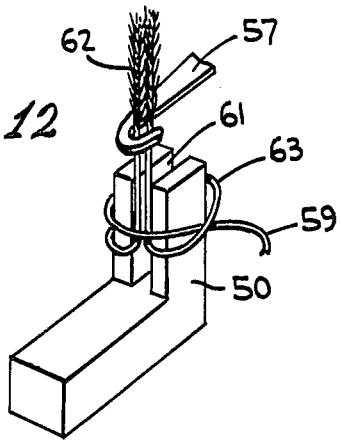
Figure 13:
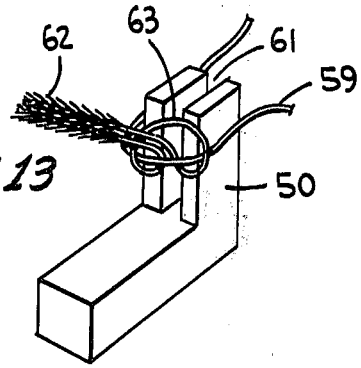

In FIG. 4, for example, needle 56 has been introduced in notch 61 with the needle tip under loop 58 of a previously formed stitch. Alternatively, (FIG. 5) the needle can be introduced under loop 58 but upside down and on the outside of the support. After having operated by one of these two modes, the needle is raised from the support together with loop 58 (FIG. 6) leaving the support empty. In FIG. 11 the needle has been lowered again so that its thread 59, coming out of the tip of the needle, is arranged around the perimeter of the support. Subsequently, FIG. 8, the needle is pulled back so that loop 58 leaves the needle and is released into the already formed knit fabric and the section of thread 59 forms a new loop around the perimeter of the support. This operation is then repeated on selected succeeding supports returning to the support first operated on. As shown in FIG. 9, the central support has been excluded from the operation to obtain greater spacing between a pair of stitches. In the arrangement shown in FIGS. 2 and 3, there are thirty-six supports to form a row with a maximum of thirty-six stitches. This operation can be operated leaving one or more supports idle in order then to return to them in the same row or in one of the following rows, or one can operate several times on the same supports. Also, circular knitting can be effected. To produce pile fabrics, the procedure for adding pile staples to the knit fabric is shown in FIGS. 9–13. In FIGS. 9 and 10 a staple 62/63 has been placed on a support 50 above loop 59 which forms part of the fabric already knitted. In FIG. 11 a separate hook 57, not carrying other yarn, has been introduced with its tip under loop 59. Then the two ends of the staple are hooked to the hook. In FIG. 12 the hook protected by the two walls of notch 61 has been pulled above the support together with the two ends of the staple, without running into the loops to be protected which are present on the outside of the walls of the support. In FIG. 13 the part of the staple 62 which forms a loop 63 has been raised and hence freed from the support, so that a knot can be formed held only by loop 59. The knot having been formed, knitting is resumed as in FIGS. 4–8, thereby incorporating a pile staple into the knit fabric.

The embodiment of the invention shown in FIGS. 14–18 illustrate an alternative form of knitting supports. In the drawings, the supports 80 are shown for illustrative purposes as being arranged in line at the edge of a linear base member 82 for the production of a planar fabric. As with the previous embodiment, however, it will be understood that the supports could also be arranged around the perimeter of a circular, oval or other shape of base member to produce tubular knit fabrics.

The supports 80 are similar in form to the supports 50 of the previous embodiment and each comprise a forward upright portion 84 and a rearwardly extending linear flange portion 86. The lateral surfaces of the upright portions again have longitudinal grooves 87 which extend down to the base member so that the upper surfaces of the flange portions 86 are at a level above the bottom of the grooves 87. With this arrangement, when yarn is looped successively around adjacent supports, as shown for example in FIG. 14, the loops rest on the flange portions 86 at a higher level than the yarn portions in the gaps between adjacent supports. This allows insertion of a needle in groove 87 for the purpose of lifting a loop off of a support during the knitting process. In this embodiment the slots in the upright portions of the supports are omitted.

This embodiment also utilizes a needle or needles similar to that of the previous embodiment. Again, the needle 90 has a planar arched forward end terminating in a tip, with a first yarn-threading eye 92 adjacent the tip, and a second yarn threading eye 94 at the crest of the arch. In this case, a third yarn-threading eye 96 is provided behind the arched forward end of the needle in a projecting portion of the needle, defining a depression 95 between the projection and the arch.

Figure 14:
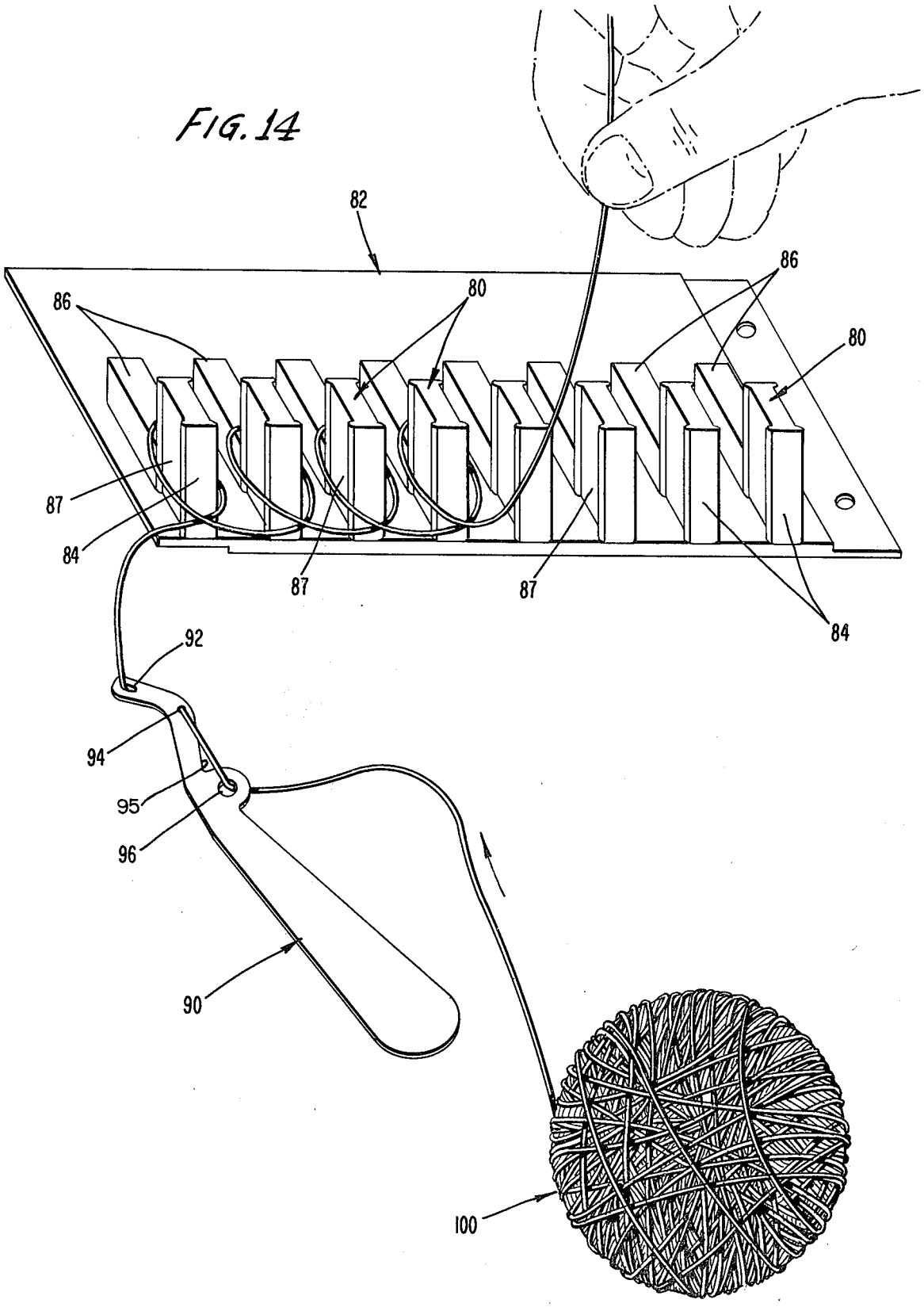

The steps in a knitting process are sequentially illustrated in FIGS. 14–18. Firstly, as shown in FIG. 14, yarn from a supply 100 is threaded alternately through the three needle eyes from the rearmost eye 96 so that alternate yarn loop portions are formed on opposite sides of the needle. The free end of the yarn is then looped around successive supports, the number of supports used depending on the number of stitches required in a row.

The next stage, as shown in FIG. 15, is to pull the yarn coming from the loop on the first support of the row outwardly a little way to achieve a desired tension and insert the needle downwardly into the outermost groove 87. Then the loop surrounding the first support is lifted off the support (FIG. 16) and held on the needle in the depression between the arched forward end and the eye 96. Subsequently, the arched forward end of the needle is worked over the first support to insert the upright portion of the support between the needle and yarn portion 102 (see FIG. 17). The yarn coming from the loop is then released and this is followed by withdrawal of the needle outwardly towards the knitter to complete the formation of a stitch on the first support. The process, as described in relation to FIGS. 15, 16 and 17, is then repeated on succeeding supports to complete a row and further repeated row by row until casting off is required. Casting off is illustrated in FIG. 18.

Pile fabrics can also be produced, as with the preceding embodiment, by inserting staples in similar manner to that previously described using grooves 88 for the staple insertion.

Figure 19:
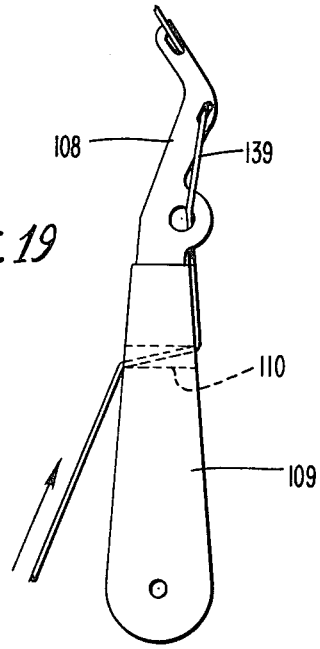
FIGS. 19 and 20 are a side view and plan, respectively, of a needle structure having a number of individual needles.
Figure 20:
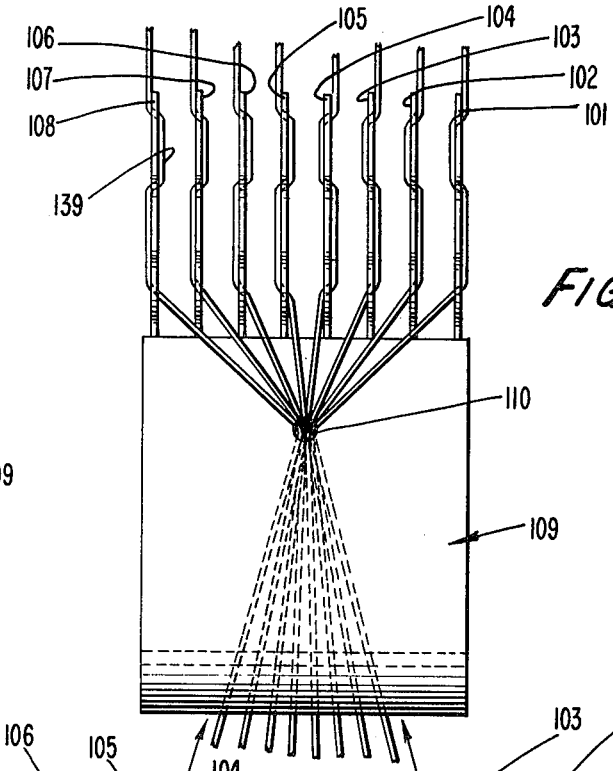

The needle structure illustrated in FIGS. 19 and 20 enables more rapid knitting to be effected on a machine employing knitting supports of the type previously described. Further, using this combination of needle structure and knitting supports as previously described, it is possible to produce a variety of patterns and stitch formations which have not previously been possible on manual knitting machines. As evident from FIGS. 19 and 20, the needle structure comprises a plurality of needles 101 to 108 each of the type described with reference to FIGS. 14–18, and which are carried by a common handle or stock 109. Each of the needles 101 to 108, as previously described, has an arched forward end and three yarn threading eyes and the spacing between the needles corresponds to the spacing (or a multiple thereof) between the individual supports on the machine with which the multi-needle structure is used. The handle 109 has a single through-bore 110 and in use, as shown in FIG. 20, individual yarns from separate yarn supplies are threaded through this bore and are then threaded individually through the respective needles in the manner previously described.

As shown in FIG. 20 the needles are arranged in parallel on handle 109 so that the individual needle tips are in linear alignment. This structure is intended primarily for use with a machine in which the knitting supports are linearly disposed. It is also however possible to use this needle structure with a machine in which the supports are arranged on an arc of a circle provided the radius of curvature of the arc is sufficiently large. For machines having the supports arranged on a circular arc with a smaller radius of curvature, the setting of the individual needles in handle 109 can be such that the needle tips lie on a curve conforming to the curve of the supports. Further, while the needle structure of FIGS. 19 and 20 is shown as having eight individual needles, it will be understood that any convenient number of such needles can be used on a common handle.

Figure 21:
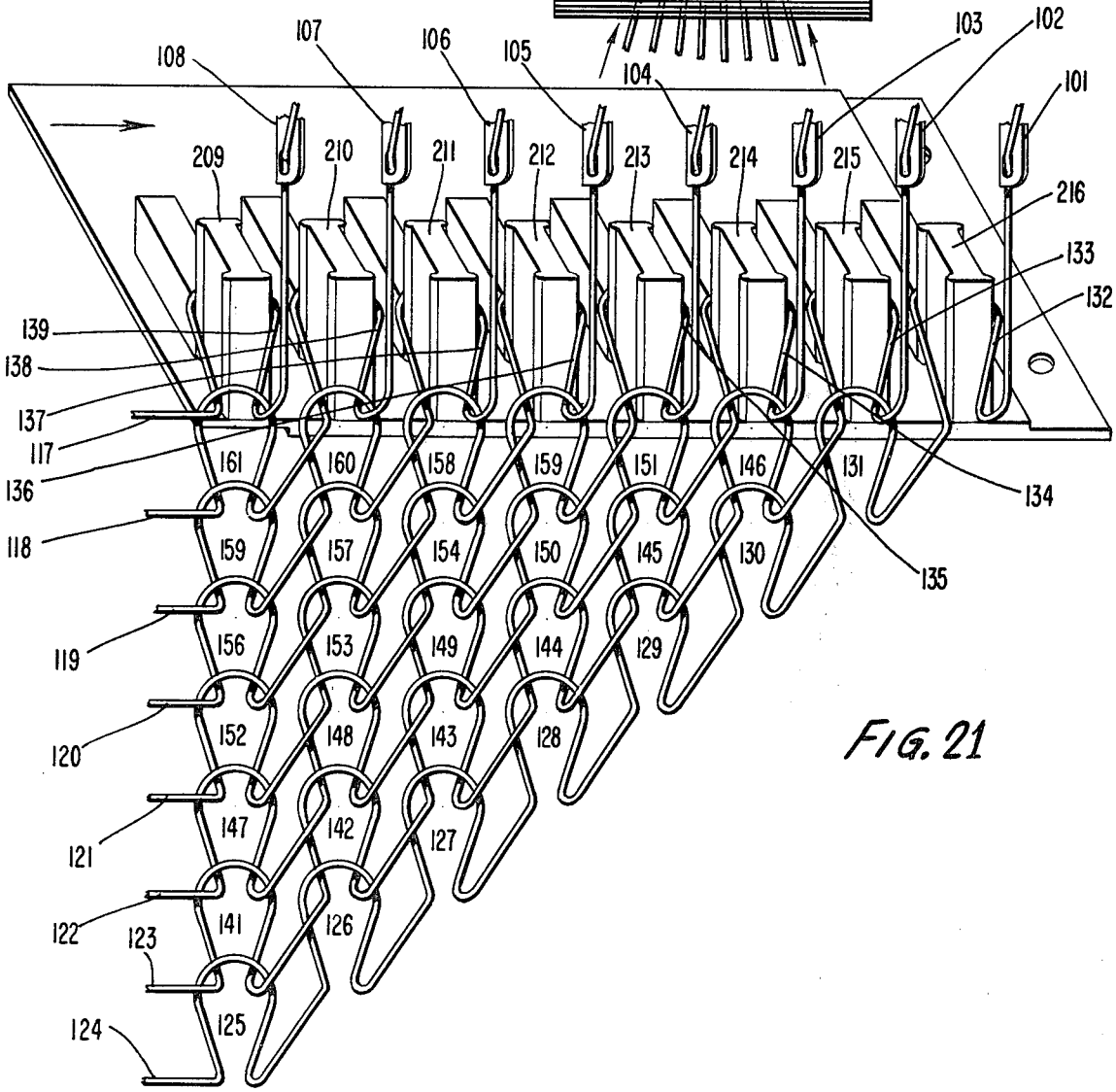
FIG. 21 is a perspective view of a knitting apparatus illustrating the manner of using the multi-needle structure.

One manner of using the multi-needle structure on a machine having linearly disposed knitting supports is illustrated in FIG. 21. In this example, needle 101 is threaded with yarn 124, needle 102 with yarn 123, needle 103 with yarn 122, needle 104 with yarn 121, needle 105 with yarn 120, needle 106 with yarn 119, needle 107 with yarn 118 and needle 108 with yarn 117.

Knitting is commenced with the needle structure at the extreme left-hand end of the machine and initially only needle 101 is used to form stitch 125 on support 209 in the manner described in relation to the previous embodiment. After completion of stitch 125, the needle structure is moved to the right by one step and needles 101 and 102 are used to form stitches 126 and 141 on supports 210 and 209, respectively. Again, after these stitches are completed, the entire needle structure is moved another step to the right and needles 101, 102 and 103 are used to form stitches 127, 142 and 147 on supports 211, 210 and 209, respectively. This process is repeated, moving the needle structure step-by-step to the right after each stitch formation until, in the illustrated position, each of the individual needles forms a stitch on one of the supports. Then, the process is continued, by moving the needle structure step-by-step further to the right until only needle 108 knits a single stitch on support 216. This completes eight rows of knitting, each row containing eight stitches (one "row" is constituted by the stitches produced from each individual needle; thus needle 101 produces the row containing stitches 125,126,127,128, 129, 130, 131 and 132).

After completion of the eight rows of stitches, as described above, knitting of subsequent sets of eight rows can be continued with the needle structure progressing in stepwise manner in either the left- or right-hand direction. This facility enables a large variety of patterns to be produced and the effects can be further varied by utilizing different colors or characteristics of threads for the various needles. Pile fabrics can also be produced by the inclusion of staples as previously described.

While the present invention has been described with reference to particular embodiments thereof, it will be understood that numerous modifications can be made by those skilled in the art without departing from the scope of the invention, as defined in the appended claims.

I claim:

1. Apparatus for producing knit fabrics comprising a base member having an outer edge, a series of substantially equally spaced knitting supports arranged along said outer edge of said base member, each knitting support having an outer upright portion with a free upper surface and a flange portion extending rearwardly of said upright portion, said flange portion having an upper surface below the upper surface of said upright portion, said upright portion having at least one lateral surface defining a longitudinal groove extending from the upper surface of said upright portion to below the level of said upper surface of said flange portion and at least one needle for use in forming stitches on said knitting supports, said needle having a planar arched forward end portion including a crest and terminating in a tip, a first yarn-threading eye in said forward end portion adjacent said tip and a second yarn-threading eye in said forward end portion spaced rearwardly from said first yarn-threading eye.

2. The apparatus of claim 1, wherein said second yarn-threading eye is positioned substantially at the crest of said arched forward end portion of said needle.

3. The apparatus of claim 1 or claim 2 wherein said needle includes a third yarn-threading eye rearwardly of said arched forward end portion.

4. The apparatus of claim 3, wherein said needle includes a projecting portion rearwardly of said arched forward end portion and defining a depression therebetween.

5. The apparatus as defined in claim 4, wherein said third yarn-threading eye is formed in said projecting portion.

6. The apparatus of claim 1, wherein said base member has a linear outer edge and said supports are arranged in line along said linear outer edge.

7. The apparatus of claim 1 or claim 2 including a plurality of said needles and a common handle for said needles, said needles being arranged on said handle in parallel and having a spacing between the needles conforming to the spacing between said supports.

8. The apparatus of claim 7, wherein the tips of said needles are disposed in linear alignment.

9. The apparatus of claim 7, wherein said handle includes means defining a yarn-threading through-bore.

* * * * *